United States Patent [19]

McGrath

[11] Patent Number: 4,914,413

[45] Date of Patent: Apr. 3, 1990

[54] TRANSFORMER WITH LAYER-WOUND AND RANDOM WOUND WINDINGS

[75] Inventor: Roger A. McGrath, Huntington, Ind.

[73] Assignee: MagneTek, Inc., Los Angeles, Calif.

[21] Appl. No.: 398,232

[22] Filed: Aug. 24, 1989

[51] Int. Cl.[4] ..... H01F 15/14; H01F 27/28

[52] U.S. Cl. ..... 336/70; 336/190; 336/206

[58] Field of Search ..... 336/69, 70, 190, 198, 336/208, 206, 220, 221

[56] References Cited

U.S. PATENT DOCUMENTS

| | | | |
|---|---|---|---|
| 3,212,172 | 10/1965 | Davis | 336/190 X |
| 3,419,837 | 12/1968 | Marshall | 336/190 X |
| 3,947,795 | 3/1976 | Donnelly et al. | 336/184 |
| 4,001,746 | 1/1977 | Tjernstrom et al. | 336/62 |
| 4,017,815 | 4/1977 | Sauer | 336/70 |
| 4,039,924 | 8/1977 | Scales et al. | 336/65 |
| 4,096,410 | 6/1978 | Alley | 315/86 |
| 4,153,891 | 5/1979 | McNutt | 336/70 |
| 4,216,455 | 8/1980 | Hester | 336/160 |
| 4,311,979 | 6/1982 | Graul | 336/205 |
| 4,454,492 | 6/1984 | Thackray | 336/69 |
| 4,522,771 | 6/1985 | McLoughlin | 264/61 |
| 4,725,804 | 2/1988 | Yarpezeshkan | 336/5 |
| 4,733,213 | 3/1988 | Graul | 336/206 |

*Primary Examiner*—Thomas J. Kozma
*Attorney, Agent, or Firm*—Faegre & Benson

[57] ABSTRACT

An improved transformer for withstanding and decoupling high voltage input impulses has a layer wound primary with interlayer insulation also serving as a spacer between the primary winding and the secondary winding and also as a spacer between the primary winding and the core. The secondary is preferably random wound on a preformed bobbin. A spaced adjacent relationship between the primary and secondary reduces the mutual inductance and interwinding capacitance.

9 Claims, 2 Drawing Sheets

TRANSFORMER WITH LAYER-WOUND AND RANDOM WOUND WINDINGS

BACKGROUND OF THE INVENTION

This invention relates to the field of transformers, more particularly transformers intended for use in watt hour meters which must be capable of withstanding and rejecting transient voltages.

In the past, watt hour meter transformers were subject to failure due to induced high voltage transients caused, for example, by nearby lightning strikes. In addition, such transformers suffered the deficiency of coupling such transients to electronic watt hour meter circuitry causing electronic malfunctions in circuitry connected to the transformer.

DETAILED DESCRIPTION

Figure 1:
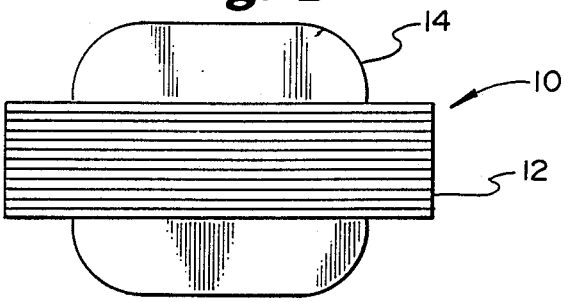
FIG. 1 is an end view of the secondary end of a transformer of the present invention.
Figure 2:
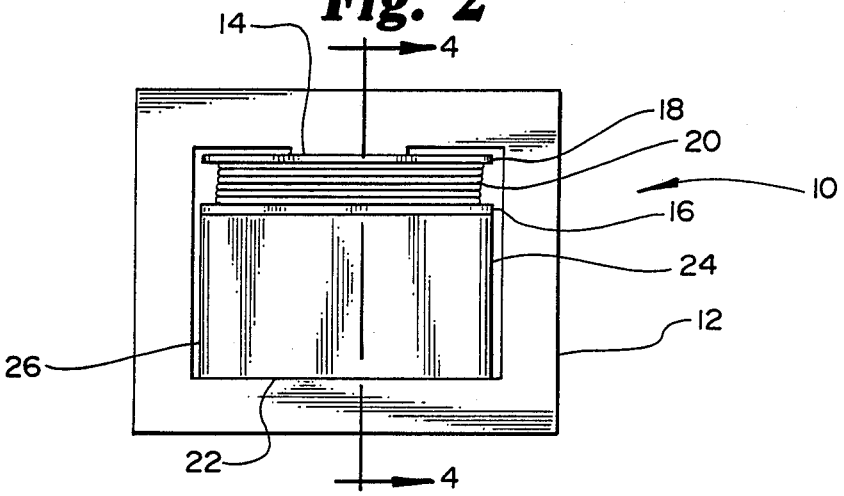
FIG. 2 is a side view of the transformer of the present invention.
Figure 3:
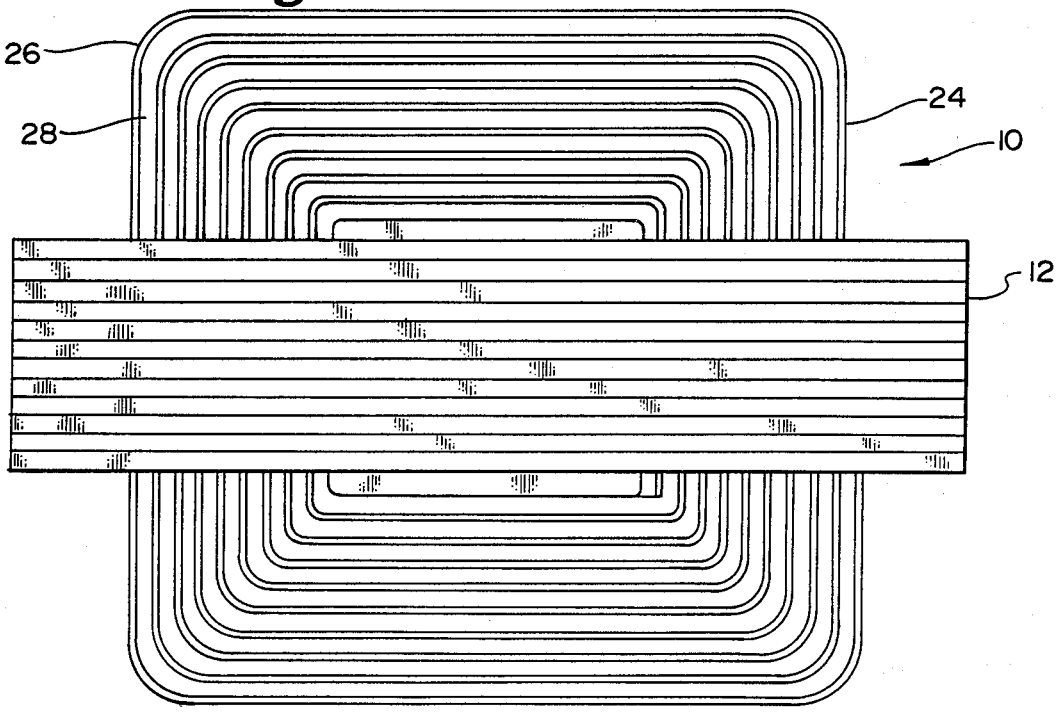
FIG. 3 is an end view of a transformer showing the primary end embodying the present invention.
Figure 4:
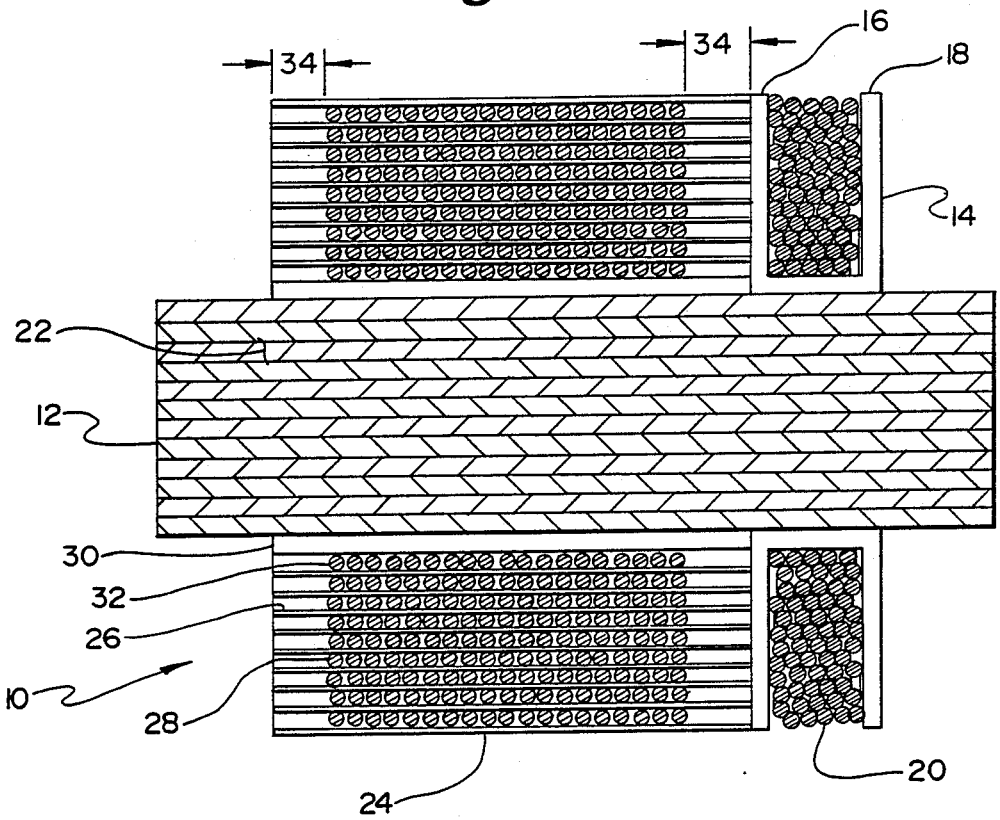
FIG. 4 is a schematic cross-section view taken along line 4—4 of FIG. 3.

The present invention overcomes deficiencies of the prior art by providing an improved transformer for withstanding and decoupling high voltage input impulses such that stresses imposed by high voltage impulses imposed on the primary coil are reduced and decoupled from the secondary coil to both permit the transformer to withstand high voltage impulses without catastrophic failure and to reduce the influence such impulses have on circuitry connected to the secondary of the transformer.

Referring now to the Figures, an improved transformer 10 embodying the present invention may be seen. Transformer 10 preferably has a laminated iron core of the E-I type stack. A bobbin 14 preferably having two flanges 16, 18 preferably carries a random-wound secondary coil 20. Secondary coil 20 in bobbin 14 is preferably carried on the center leg 22 of core 12. Center leg 22 also preferably carries a layer wound primary coil 24 which is preferably mounted and spaced adjacent relationship to the secondary coil 20 on core 12. A plurality of layers of electrical insulation 26 are preferably interposed between each pair of adjacent layers of a plurality of successive winding layers 28 in primary coil 24. An electrically insulating core tube 30 is preferably formed of a U.L. approved electrical paper and is preferably interposed between an innermost layer 32 of the primary coil 24 and said core 12. Both the layers 26 of insulation and the core tube 30 preferably extend a predetermined distance 34 beyond opposite sides of primary coil 24 to act as a spacer to position the primary coil 24 the predetermined distance from the bobbin 14 carrying the secondary coil 20 on one side and may also serve to space primary coil 24 the same or another predetermined distance 34' from core 12 on the other side of primary coil 24. The primary is constructed as a paper section coil utilizing insulation of the same type as that used to form tube 30 placed between successive layers of turns in the primary coil 24. This insulation, commonly referred to as layer insulation, reduces the voltage stresses from one layer of primary coil 24 to the adjacent layer. Such layer insulation has been found to permit transformer 10 to pass impulse testing in excess of 7 KV.

The secondary coil 20 is preferably random-wound on a two flange bobbin 14, preferably formed of a U.L. approved thermoplastic material. The predetermined spacing 34 between primary coil 24 and secondary coil 20 reduces the mutual inductance from primary 24 to secondary 20, thus reducing the effect that transients on primary 24 have on secondary 20. In a preferred embodiment of this invention, it has been found useful to set the predetermined primary-to-secondary distance equal to 0.094 inches. With such spacing, a 7 KV impulse is substantially decoupled from secondary coil 20.

A still further improvement in this design over conventional design transformers is in the interwinding capacitance. One prior art design used in this application has been found to have an interwinding capacitance of 75 pf while a transformer embodying the design of the present invention has been found to exhibit only 19 pf.

The invention is not to be taken as limited to all of the details thereof as modifications and improvements may be made while remaining within the spirit and scope of the invention as claimed.

What is claimed is:

1. An improved transformer for withstanding and decoupling high voltage input impulses comprising:

(a) a laminated iron core;

(b) a random-wound, secondary coil carried by a bobbin on said core;

(c) a layer-wound primary coil mounted in spaced adjacent relationship to said secondary coil on said core; and (d) electrical insulation means interposed between successive layers of windings in said primary coil for reducing stresses imposed by high voltage impulses imposed on said primary coil and wherein said impulses are decoupled from said secondary by said spaced adjacent relationship between said primary and secondary coils.

2. The transformer of claim 1 wherein the core is an E-I type laminated stack.

3. The transformer of claim 1 wherein the electrical insulation extends a predetermined distance beyond at least one side of said primary coil.

4. The transformer of claim 3 wherein said insulation acts as a spacer to position said primary coil the predetermined distance from the bobbin carrying the secondary coil.

5. The transformer of claim 3 wherein said insulation extends a second predetermined distance beyond an opposite side of said primary coil.

6. The transformer of claim 5 wherein said insulation acts to space said primary coil the predetermined distance from said core on one side and said bobbin on the other side of said primary coil.

7. The transformer of claim 6 further comprising:

(e) an electrically insulating core tube interposed between an innnermost layer of said primary coil and said core, and extending substantially the predetermined distance beyond opposite sides of said primary coil.

8. The transformer of claim 1 further comprising:

(e) electrically insulating core tube means interposed between said primary coil and said core and extending a predetermined distance beyond at least one side of said primary coil adjacent said bobbin for spacing said primary coil from said secondary coil bobbin.

9. The transformer of claim 8 wherein said electrical insulation means and said core tube means both act as spacers to position said primary coil the predetermined distance from the secondary coil bobbin.

* * * * *